US005540554A

United States Patent [19]

Masuzawa

[11] Patent Number: 5,540,554

[45] Date of Patent: Jul. 30, 1996

[54] METHOD AND APPARATUS FOR CONTROLLING HYDRAULIC SYSTEMS OF CONSTRUCTION EQUIPMENT

[75] Inventor: Jun Masuzawa, Kobe, Japan

[73] Assignee: Shin Caterpillar Mitsubishi Ltd., Tokyo, Japan

[21] Appl. No.: 318,134

[22] Filed: Oct. 5, 1994

[30] Foreign Application Priority Data

Oct. 5, 1993 [JP] Japan ..... 5-249205

[51] Int. Cl.[6] ..... F04B 49/00

[52] U.S. Cl. ..... 417/20; 417/53; 417/326

[58] Field of Search ..... 417/32, 17, 18, 417/20, 326, 53; 73/168; 60/329

[56] References Cited

U.S. PATENT DOCUMENTS 4,388,043 6/1983 Preiss .

FOREIGN PATENT DOCUMENTS 0076876 10/1981 European Pat. Off. .
0457365 8/1987 European Pat. Off. .
626226548 11/1987 European Pat. Off. .
432578 4/1991 European Pat. Off. .
7042156 11/1970 France .
7509139 3/1975 France .

*Primary Examiner*—Richard E. Gluck
*Assistant Examiner*—Xuan M. Thai
*Attorney, Agent, or Firm*—Mark A. Catan; Thomas R. Morrison; Morrison Law Firm

[57] ABSTRACT

A controller regulates a hydraulic pump for hydraulic equipment to allow long-term use of environmentally safe hydraulic fluids. This is accomplished by limiting the hydraulic pump power output to a level established to prevent the operating temperature from exceeding a specified level. A manual mode for switching between power curves permits alternate use of hydraulic fluids having different maximum operating temperatures. An automatic mode detects the type of hydraulic fluid and automatically selects and applies a suitable power mode curve to limit the maximum operating temperature to a value suitable for the detected type of fluid.

6 Claims, 2 Drawing Sheets

METHOD AND APPARATUS FOR CONTROLLING HYDRAULIC SYSTEMS OF CONSTRUCTION EQUIPMENT

BACKGROUND OF THE INVENTION

This invention relates to devices that control power output of hydraulic equipment and particularly to such devices that control the output of hydraulic equipment to permit the use of degradable, environmentally-safe, oils for hydraulic fluid.

Although mineral oils have been used as working fluids for hydraulic systems, such as construction equipment, there is a trend, particularly in European nations, to proscribe the use of mineral oils under certain conditions because such oils are environmentally hazardous. Environmentally safe alternatives to mineral oils are available and used in jurisdictions that do not allow the use of mineral oils. For example, biodegradable fluids made from vegetable oil, such as rape (canola) seed oil, are among these few feasible alternatives.

Unfortunately, from a practical standpoint, biodegradable working fluids are inferior substitutes, in some ways, for mineral oils. Such biodegradable fluids are not stable for long periods of time, especially at the high temperatures produced by some hydraulic systems. For example, the usable temperature range of biodegradable working fluid of a rape seed oil type of fluid is from −20° C. to +80° C. while the temperature of the hydraulic fluid in a working hydraulic excavator sometimes exceeds +90° C., despite the use of an oil cooler. Thus it is impractical to use such biodegradable working fluids in such systems. This is particularly true for systems with oil coolers that are sized for use with mineral oils because such systems lack the capacity to maintain the lower fluid temperatures required for continuous use of biodegradable oils.

In countries where use of biodegradable working fluid is required, various measures have been adopted to accommodate the lower temperature requirements of biodegradable oils. One measure is to change the hydraulic fluid before it becomes degraded by increasing the frequency of replacement. Another is to increase the capacity of the oil cooler. Still another is to sound an alarm when excess temperatures are detected and allow the machine to cool down. However, these countermeasures present problems. Increasing the frequency of changes of the working fluid increases the operating cost of the machine. Increasing the capacity of the oil cooler adds initial cost to the hydraulic equipment. Waiting for the equipment to cool down, after excess temperatures are detected, decreases the duty cycle of the equipment and increases operating and labor costs.

OBJECTS AND SUMMARY OF THE INVENTION

An object of the present invention is to provide an automatic means for regulating a hydraulic system to limit fluid temperatures to levels acceptable for long-term use of biodegradable oils.

Another object of the present invention is to allow the use of different kinds of hydraulic fluid to be used in the same type of hydraulic equipment without exceeding the optimum performance parameters of each hydraulic fluid.

Still a further object of the present invention is provide a means by which hydraulic machinery may be automatically switched to a mode which limits the temperature of the hydraulic fluid to lower operating temperatures.

Still another object of the present invention is to provide a method of controlling the hydraulic system of construction equipment that can be applied easily to various types of working fluids, each having different maximum usable temperatures.

Briefly stated, the present invention provides a control to regulate a hydraulic pump for hydraulic equipment to allow long-term use of environmentally safe hydraulic fluids. This is accomplished by limiting the hydraulic pump power output to a level established to prevent the operating temperature from exceeding a specified level.

According to an embodiment of the present invention, there is described, a device for limiting the maximum operating temperature of a hydraulic fluid, comprising: a hydraulic pump for pumping hydraulic fluid, means for regulating a power output of the hydraulic pump, means for establishing at least one normal power mode of the means for regulating, each of the at least one being defined by a respective characteristic flow-versus-pressure curve, means for establishing a special power mode of the means for regulating and the special power mode being defined by a special characteristic flow-versus-pressure curve determined to limit a maximum operating temperature of the hydraulic fluid to a specified temperature.

According to another embodiment of the present invention, there is described, a method of controlling a piece of hydraulic equipment having a hydraulic pump, comprising: determining a characteristic power operating curve of the piece of hydraulic equipment at which a specified temperature is not exceeded, the characteristic curve being associated with a particular value of a power level signal for controlling the hydraulic pump and limiting the power level signal to the particular value.

According to still another embodiment of the present invention, there is described, a device for limiting the maximum operating temperature of a hydraulic fluid of a piece of hydraulic equipment, comprising: means for generating power output control signals, a motor, governor means for regulating a power output of the motor, a hydraulic pump driven by the motor, power level control means for regulating an output of the hydraulic pump, a controller for controlling the governor means and the power level control means responsively to the power output control signals to provide a specified characteristic flowrate-versus-pressure curve of the output of the hydraulic pump, a continuous operation of the piece of hydraulic equipment at the specified characteristic flowrate-versus-pressure curve causing the hydraulic fluid to reach a maximum temperature and the means for generating power output control signals including means for generating a control signal for limiting the specified characteristic flowrate-versus-pressure curve of the output of the hydraulic pump to a specified power level whereby the maximum temperature is limited to a specified temperature.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
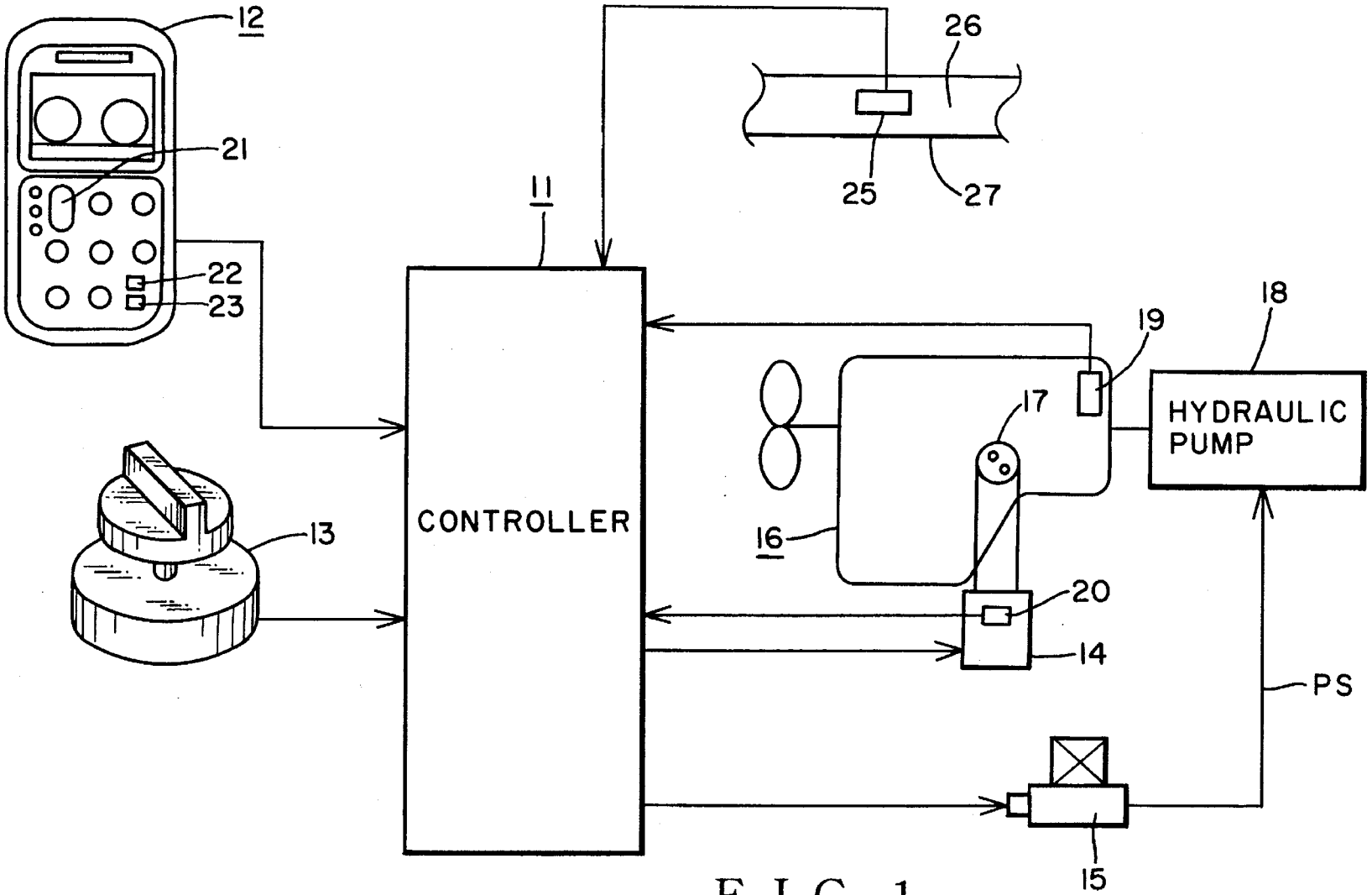
FIG. 1 is a system diagram of a control system for an engine and a pump according to an embodiment of the present the invention.

Referring to FIG. 1, a system for controlling a diesel engine 16 and a hydraulic pump 18 of a piece of construction equipment, such as a hydraulic excavator, is controlled by a controller 11. Input signals to controller 11 are applied by a monitor 12 and a rotary dial 13. Monitor 12 and rotary dial 13 are located in a cab of the equipment and operated by an equipment operator. Controller 11 applies output control signals to a governor actuator 14 and an electromagnetic proportional control valve 15. Governor actuator 14 operates a governor pulley 17 of diesel engine 16 to control the output of diesel engine 16.

Electromagnetic proportional control valve 15 applies a power shift pressure PS through a hydraulic control line to hydraulic pump 18 responsively to electrical signals applied by controller 11 to control hydraulic pump 18. The power shift pressure PS is a mechanical control signal which operates a regulator (not shown) of hydraulic pump 18 to control output power of hydraulic pump 18. Working fluid discharged from hydraulic pump 18 is fed to a hydraulic circuit of a travelling system or a working system of the construction equipment.

A speed sensor 19 of diesel engine 16 applies a signal, indicating an operating speed of diesel engine 16 to controller 11. A feedback sensor 20 of governor actuator 14 applies a signal indicating a governor output to controller 11.

Figure 2:
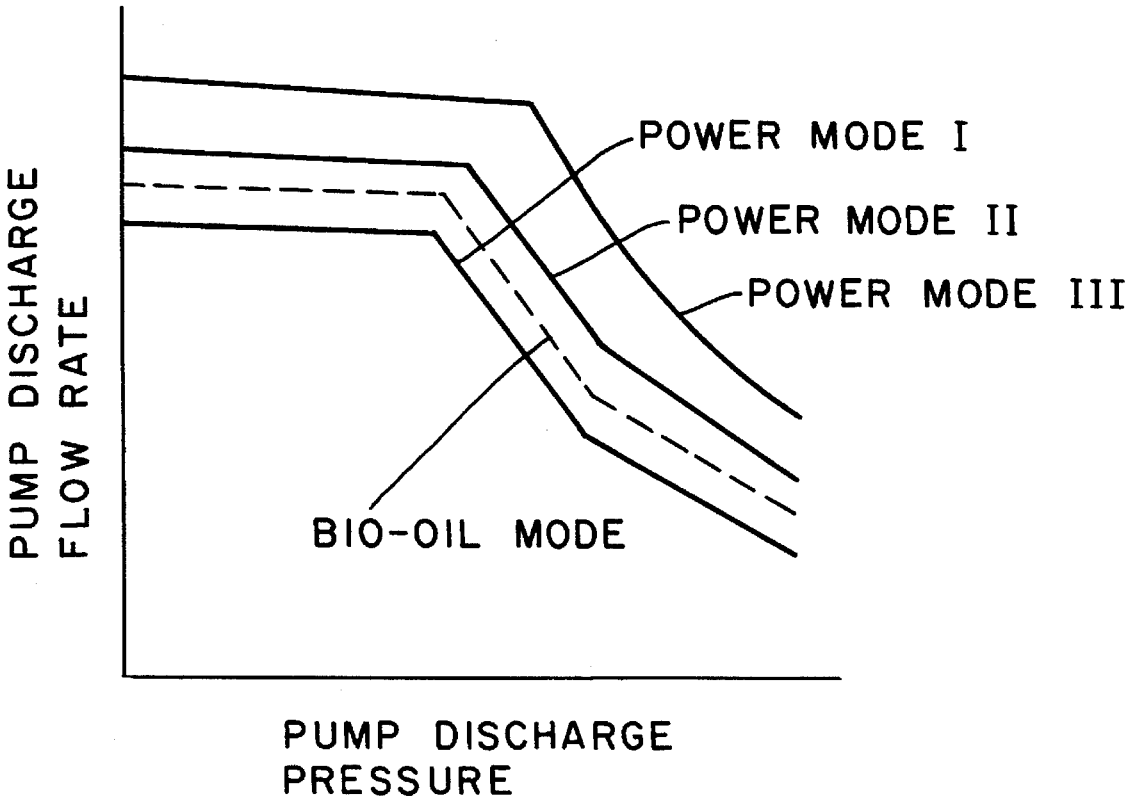
FIG. 2 shows pressure/flow rate characteristic curves of a hydraulic pump controlled by the control method of the present invention.

Referring to FIG. 2, controller 11 has multiple power modes represented by respective pump pressure/flow rate characteristic curves. Through monitor 12, the equipment operator controls the current power mode of controller 11. A setting switch 22, a release switch 23, and a power mode selecting switch 21 apply respective control signals to controller 11 to establish a current power mode of controller 11. Controller 11 controls electromagnetic proportional control valve 15 and governor actuator 14 to maintain operation of hydraulic pump 18 in accord with the selected power mode curve.

The maximum temperature of the working fluid can be limited by limiting operation of the equipment to a selected power mode. According to one embodiment of the invention, three "normal" power modes are provided: I, II, and III. When the working fluid is changed from a mineral oil type to a biodegradable type, for example an environmentally-safe rape seed oil type, the operator presses mode setting switch 22 to select a special bio-oil mode. The selection of bio-oil mode reduces power shift pressure PS to a level less than that of power mode II or III. This causes controller 11 to apply control signals to hydraulic pump 18 to reduce the power output of hydraulic pump 18 to a level represented by a dotted line in FIG. 2. The latter level is lower than respective power levels for power modes II and III. The power level of the bio-oil mode is selected to be the highest possible power level that prevent the maximum operating temperature of the working fluid from being exceeded.

Although the operator cannot select among power modes I, II, and III when the bio-oil mode is selected, the bio-oil mode allows biodegradable working fluid to be used. For example, for rape-seed oils, the allowable temperature range, −20° C. to +80° C., is not exceeded when the output power of hydraulic pump 18 is limited in this way. Because of the limited working temperatures during operation in bio-oil mode, the life span of the biodegradable working fluid is extended.

The bio-oil mode may be terminated by operating release switch 23. When release switch 23 is actuated, one of power modes I, II and III is reinvoked. Although, in the present embodiment, switching between a power mode and the bio-oil mode is effected by manual operation of bio-oil mode setting switch 22 and its release switch 23, other means of switching are possible. For example, the type of working fluid in an oil tank can be automatically detected by an oil type sensor. An ultrasonic sensor 25, which automatically determines the type of oil 26, in a vessel or conduit 27 of the hydraulic system, and applies a corresponding signal to controller 11. In this case, controller 11 may automatically set the power mode according to the type of oil. The function of monitor 12, in this case, may be changed to a mere indicator of oil type and power mode, rather than its function in the prior embodiment of accepting control inputs.

Ultrasonic sensor 25 operates on the characteristic that the transmission speed of sonic waves differs depending on the density of the oil and other factors. Such an oil-type sensor could be used to automatically switch between the bio-oil mode and other working modes in response to the type of oil sensed.

In another embodiment, the means for setting the bio-oil mode is set, not by an operator during field operation of the equipment, but by a service technician or oil dealer who establishes the operating mode when new oil is transferred to the equipment. For example, the switch could be accessible to the technician in a position remote from the operator console.

In still another embodiment, hydraulic pump 18 is finally controlled by electrical signals rather than hydraulic signals. The present invention may be applied to this embodiment to allow manual switching from controller 11, or automatic mode-switching as discussed above. This could be done by controlling the final electrical signal to hydraulic pump 18, directly.

According the embodiment described, four normal power modes are established, namely, I, II, and III and a bio mode. However, it is noted that a system that has only one normal power mode for operation with mineral oil, together with a single bio mode for operation with bio-degradable oil, could be used with the present invention.

By changing the output power of a hydraulic pump, the present invention provides a means for limiting the temperatures of working fluid used in a hydraulic system. The power level is limited to a level corresponding to the actual maximum temperature of the working fluid. Therefore, according to the invention, even working fluids having maximum usable temperature that are lower than conventional fluids can be used without modifying the hydraulic system, tolerating unduly limited fluid life, or diminished equipment duty cycles. As a consequence, the present invention makes it possible selectively to use mineral oil or biodegradable oil working fluids in the same equipment.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for limiting the maximum operating temperature of a hydraulic fluid, comprising:

a hydraulic pump for pumping hydraulic fluid;

means for regulating a power output of said hydraulic pump;

means for establishing at least one normal power mode of said means for regulating;

said at least one normal power mode being defined by a respective characteristic flow-versus-pressure curve; and said at least one normal power mode limiting flow-versus-pressure curve values by which said means for regulating limits said power output to limit a maximum operating temperature of said hydraulic fluid to a specified temperature.

2. Apparatus as in claim 1, wherein said hydraulic fluid is an oil consisting substantially of vegetable oil.

3. Apparatus as in claim 1, wherein:

said at least one normal power mode is at least first and second power modes; and said second power mode is lower than said first power mode.

4. Apparatus as in claim 1, wherein said means for establishing includes:

means for determining a type of oil by sensing a speed of sound in said hydraulic fluid;

said at least one power mode being at least two power modes; and means for selecting a one of said at least two power modes in dependence on said type of oil.

5. A method for limiting the maximum operating temperature of a hydraulic fluid of a piece of hydraulic equipment having a hydraulic pump, comprising:

determining a characteristic power operating curve of said piece of hydraulic equipment at which a temperature of said hydraulic fluid remains below a predetermined temperature;

said characteristic curve being associated with a particular value of a power level signal for controlling said hydraulic pump; and employing said characteristic power operating curve for operating said hydraulic equipment.

6. A device for limiting a maximum operating temperature of a hydraulic fluid of a piece of hydraulic equipment, comprising:

means for generating power output control signals;

a motor;

governor means for regulating a power output of said engine; a hydraulic pump driven by said engine;

power level control means for regulating an output of said hydraulic pump;

a controller for controlling said governor means and said power level control means responsively to said power output control signals to provide a specified characteristic flowrate-versus-pressure curve of said output of said hydraulic pump;

a continuous operation of said piece of hydraulic equipment at said specified characteristic flowrate-versus-pressure curve causing said hydraulic fluid to remain below a maximum temperature; and said means for generating power output control signals including means for generating a control signal for limiting said specified characteristic flowrate-versus-pressure curve of said output of said hydraulic pump to a specified power level whereby said maximum temperature is limited to a specified temperature.

* * * * *